US006546691B2

(12) United States Patent
Leopolder

(10) Patent No.: US 6,546,691 B2
(45) Date of Patent: Apr. 15, 2003

(54) METHOD OF LAYING PANELS

(75) Inventor: Christian Leopolder, Lampertswalde (DE)

(73) Assignee: Kronospan Technical Company Ltd., Nicosia (CY)

( * ) Notice: Subject to any disclaimer, the term of this patent is extended or adjusted under 35 U.S.C. 154(b) by 0 days.

(21) Appl. No.: 09/736,054

(22) Filed: Dec. 13, 2000

(65) Prior Publication Data

US 2002/0069611 A1 Jun. 13, 2002

(51) Int. Cl.[7] ..... E04B 5/00

(52) U.S. Cl. ..... 52/747.1; 52/590.2; 52/590.3; 52/747.11; 52/592.1

(58) Field of Search ..... 52/747.11, 748.1, 52/590.2, 590.3, 586.2, 551, 480

(56) References Cited

U.S. PATENT DOCUMENTS

| | | | | |
|---|---|---|---|---|
| 1,124,228 A | * | 1/1915 | Houston | 52/403.1 |
| 2,430,200 A | * | 11/1947 | Wilson | 20/92 |
| 2,740,167 A | * | 4/1956 | Rowley | 20/8 |
| 5,295,341 A | | 3/1994 | Kajiwara | |
| 5,570,554 A | * | 11/1996 | Searer | 52/539 |
| 5,706,621 A | | 1/1998 | Pervan | |
| 6,006,486 A | * | 12/1999 | Moriau et al. | 52/589.1 |
| 6,023,907 A | | 2/2000 | Pervan | |
| 6,119,423 A | * | 9/2000 | Costantino | 52/390 |
| 6,182,410 B1 | * | 2/2001 | Pervan | 52/403.1 |
| 6,216,409 B1 | * | 4/2001 | Roy et al. | 52/589.1 |
| 6,324,803 B1 | * | 12/2001 | Pervan | 52/403.1 |

FOREIGN PATENT DOCUMENTS

| | | |
|---|---|---|
| EP | 0 005 252 B1 | 5/1982 |
| EP | 0 001 359 B1 | 1/1985 |

* cited by examiner

*Primary Examiner*—Carl D. Friedman
*Assistant Examiner*—Jennifer I. Thissell
(74) *Attorney, Agent, or Firm*—Renner, Otto, Boisselle & Sklar, LLP

(57) ABSTRACT

The present invention provides a method of laying and mechanically joining panels, especially floor panels. In a first step a first panel is already located in a first row. A second panel is positioned in a second row in a first position in relation to the first panel. A third panel is now brought into the second row and into the first position in relation to the first panel. In this position, there is a mutual distance between the adjacent edges of the second and third panel. In a second step the second and third panel are angled into the third mutual position in relation to the first panel. Thereby, the second and third panel each achieve the possibility of easy displacement in the third direction in relation to the first panel. In a third step one or both of the second and third panel are moved in relation to the first panel. By this displacement the second and third panel get in a second position in relation to each other. An additional intermediate step may be employed between the first and the second step. In this intermediate step the second and third panel are angled down into the second mutual position in relation to the first panel.

12 Claims, 4 Drawing Sheets

METHOD OF LAYING PANELS

TECHNICAL FIELD

The invention generally relates to a method of laying and mechanically joining panels providing a joint along adjacent joint edges of two panels, especially floor panels.

More specifically, the joint is of the type where the adjacent joint edges together form a first mechanical connection locking the joint edges to each other in a first direction at right angles to the principal plane of the panels, and where a locking device forms a second mechanical connection locking the panels to each other in a second direction parallel to the principal plane and at right angles to the joint edges. The locking device comprises a locking groove which extends parallel to and spaced from the joint edge of one of the panels, and said locking groove is open at the rear side of this one panel.

The method of laying and mechanically joining is especially well suited for use in joining floor panels. Thus, the following description of the prior art and of the objects and features of the invention will be focused on this field of use. It should however be emphasized that the method is useful also for joining ordinary wooden floors as well as other types of building panels, such as wall panels and roof slabs.

BACKGROUND OF THE INVENTION

A joint of the aforementioned type is known e.g. from U.S. Pat. No. 5,706,621. Thereby the system of making the joint is characterized, in that the adjacent joint edges together form a first mechanical connection locking the joint edges to each other in a first direction at right angles to the principal plane of the panels.

A locking device arranged on the rear side of the panels forms a second mechanical connection locking the panels to each other in a second direction parallel to the principal plane and at right angles to the joint edges.

Said locking device comprises a locking groove which extends parallel to and spaced from the joint edge of one said panels, termed groove panel, and which is open at the rear side of the groove panel.

The locking device further comprises a strip integrated with the other of said panels, termed strip panel, Said strip extends throughout substantially the entire length of the joint edge of the strip panel. It is provided with a locking element projecting from the strip. When the panels are joined together, the strip projects on the rear side of the groove panel with its locking element received in the locking groove of the groove panel.

The panels, when joined together, can occupy a relative position in said second direction because of a play that exists between the locking groove and a locking surface on the locking element.

That surface facing the joint edges is operative in said second mechanical connection.

The first and the second mechanical connection both allow mutual displacement of the panels in the direction of the joint edges due to the play.

The mutual displacement of the panels considerably facilitates the laying and enables joining together the short sides by snap action.

It is known from U.S. Pat. No. 5,706,621, that this joining system makes it possible to provide concealed, precise locking of both the short and long sides of the panels.

The following laying methods of panels comprising mechanical connections and locking devices along the short and long sides of the panels are known.

From U.S. Pat. No. 5,706,621 it is known to place the strip panel first on the subfloor and then moving the groove panel with its long side up to the long side of the strip panel, at an angle between the principal plane of the groove panel and the subfloor. When the joint edges have been engaged with each other to form the first mechanical connection, the groove panel is angled down so as to accommodate the locking element in the locking groove. Typically the long sides can be joined together by using this laying technique with downward angling of the groove panel.

The short sides are subsequently joined together by displacing the groove panel in its longitudinal direction until its short side is pressed on and locked to the short side of an adjacent panel in the same row.

Therefore these sides are typically provided with a locking system and connection system working as a snap-together locking system. Those systems normally allow the connection of two panels by only moving together those panels in their longitudinal direction. An angling of one of the panels is thereby not necessary.

A joint of the aforementioned type is known e.g. from U.S. Pat. No. 5,295,341. Thereby the strip panel is provided with a tongue connector, the groove panel with a groove connector. The tongue connector has a forward protruding tongue, the groove connector has a forward protruding groove. The tongue is provided with a pair of forward diverging sidewalls. The sidewalls can be compressed together to a narrower width. The outer opening of the groove is smaller in cross section in width than the sidewalls of the tongue when in its expanded position. By forcing the tongue into the groove the sidewalls of the tongue compress, allowing the sidewalls to pass beyond the outer opening of the groove. Once past the outer opening, the sidewalls of the tongue expand to positively interlock the two connectors and in the end the panels together.

The disadvantage of above mentioned laying method lies in the need of displacing the groove panel in its longitudinal direction. To become easily displaceable in longitudinal direction the abovementioned play in the joint connecting the longitudinal edges of two panels is made of appropriate width. If it is too wide, this play leads to a gap between the two joining panels. So there is no smooth transition between the surfaces of two panels.

A thus opened joint makes the floor prone to mechanical destruction and penetration of water. Beside that the look of the laid floor is of poor quality.

Is the play too small, the friction being effective against the longitudinal movement of the connected groove panel is too high. A force overwhelming this can destroy the panel.

The following laying method is known of U.S. Pat. No. 6,023,907.

The first panel is thereby already located in a first row. A second panel is positioned in a second row in an angled position in relation to the groove panel. Thereby adjacent edges of the two panels are in mutual contact.

A third panel is positioned in the same angled position to the first panel, but with a distance between the upper portions of the adjacent joint edges of the third panel and the first panel. It is in a common plane with the second panel and mechanically locked to each other in a first direction, that is at right angles to the common plane and in a second direction that is at right angles to the first direction and to the adjacent edges.

While maintaining said in common plane position of the second panel and the third panel, the third panel is displaced relative to the second panel, until the upper parts of adjacent edges of the first and third panel are in mutual contact.

Angling the third and the second panel together down into the common plane position with the first panel. Thereby the positions get mechanically locked analogous to the connection between the second and third panel.

Disadvantage of said laying method is the difficulty in keeping the second and third panel in the common plane position while it is necessary to displace the third panel in the above described way. Normally, a single person has difficulties to handle this.

IN THE SUMMARY OF THE INVENTION

The present invention according to claim 1 provides a method of laying and mechanically joining panels, especially floor panels.

In a first mutual position the two panels are held in an angled position to each other. Adjacent edges of the panels are in mutual contact. In general, their upper edge portions touch.

In a second mutual position the two panels are located in a common plane. Thereby, the panels are mechanically locked to each other in two directions. The first direction is right-angled to the common plane. The second direction is right-angled to the first direction and to the adjacent joint edges.

The locking is caused by a first member disposed at one of the adjacent edges which is connected to a second locking member disposed at the other one of the adjacent edges.

In a third position the two panels are held in a second angled position to each other. Said position is in between said first and second position. The locking in said first and second direction is still effective.

Said second angle is adopted to the possibility to displace easily the panels in a third direction, parallel to the adjacent joint edges without losing the locking function of said locking members in said first and second direction.

Therefore, the locking members are for instance shaped in a kind to provide a play in the joint between the panels in said second angled position.

Said method comprises the following steps. In a first step a first panel is already located in a first row. A second panel is positioned in a second row in said first position in relation to the first panel. A third panel is now brought into the second row and into said first position in relation to said first panel. In this said position, there is a mutual distance between the adjacent edges of said second and third panel.

In a second step the second and third panel are angled into said third mutual position in relation to the first panel. Thereby, said second and third panel each achieve the possibility of easy displacement in said third direction in relation to said first panel.

In a third step one or both of said second and third panel are moved in relation to the first panel. By this displacement the second and third panel get in said second position in relation to each other.

A joint between said second and said third panel is designed in a way that connecting and locking is possible by displacement in a plane.

In a fourth step said second and third panel are angled in said second position is in relation to said first panel. Thereby, all surfaces of said panels are in the same plane.

The connection between said second and third panel and the locking of this connection is achieved, while those panels are in said third position in relation to said first panel. In said third position a displacement of the panels in relation to each other can be carried out easily. Friction being effective against said displacement is brought to minimum by angling the panels in said second angle. Since the panels are locked in the other directions, a displacement in a third direction, which is in direction of the adjacent joint edges, in relation to each other cannot lead to loss of the connection.

A displacement of the panels in said second position due to friction is very difficult.

Using said laying method avoids the need of providing the play known from U.S. Pat. No. 5,706,621 in the joint between the panels, in order to carry out the displacement easily. Avoiding this play can lead to a smooth gapless surface of the laid panels.

According to an embodiment to the panels used by said laying method, two different locking members are disposed on adjacent edges of two panels, especially on the longer sides of the panels. A first locking member is a groove, which extends parallel to one of the edges and is spaced from said edge. Said groove is open at the bottom rear side of the panel, with which the panel is later in contact with the supporting surface.

A second locking member disposed on the adjacent edge of a further panel is a projection. Said projection extends parallel to said edge and is spaced from said edge. It projects toward the top surface of the panel, the side which is on top when the panel is laid.

In general each panel has a locking groove at one long side and a projection at the other long side. So that for the mechanical joining of the panels each panel edge has it counterpart at an adjacent edge of a further panel.

According to a further embodiment of the panels said locking groove is part of a tongue. Said tongue projects at one of the adjacent edges of a panel and extends parallel to that edge. It is formed to fit in a second groove which is disposed at the adjacent edge of a further panel. Said second groove is provided with said projection. Said projection is so formed and so positioned in said second groove that it can be received by said locking groove, when said tongue is brought into said second groove.

Thereby, the panels are mechanically locked to each other in two directions. The first direction is right-angled to the common plane. The second direction is right-angled to the first direction and to the adjacent joint edges.

Said projection projects to the surface of the panel, thus it is disposed on that flank of said second groove, which is located nearer to the rear side of the panel. Thereby, it is avoided, that the locking elements lead to a vaulted surface of the panels in the region of the joint.

According to a further embodiment, the flanks of said second groove are of the same length. Thereby, it is especially guaranteed, that the panels are locked in said first direction. Further, it is in general easy to provide a panel with said second groove having flanks of the same length by just one shaping action.

According to a further embodiment, that one of the flanks, on which said projection is disposed, is flexible. Thereby, it is achieved, that said second groove is able to receive said tongue in its center. This flexibility is necessary, since the tongue is in general thicker than the space in the center of the groove from the top of said projection to the opposite flank.

According to a further embodiment, that one of the flanks, on which said projection is disposed, juts out in relation to the other flank of said groove. By this a stiff joint is achieved when two panels are connected.

In general the narrow side of a panel is provided with said second groove having flanks of the same length or with said tongue respectively, the long side is provided with said second groove having a flank, that juts out, or with said tongue respectively.

Further preferred embodiments of the panels are described in the PCT-applications PCT/EP 00/01359 and PCT/EP 00/05252.

A further method for laying and mechanically joining panels according to this invention comprises an additional intermediate step between said first and said second step. In this intermediate step said second and third panel are angled down into said second mutual position in relation to the first panel.

By using this intermediate step, it is guaranteed that said second and third panel are connected and locked in relation to said first panel, before a displacement of the second and/or third panel is carried out in relation to the first panel.

Additionally, this intermediate step helps to adjust the relative positions of said second and third panel in relation to each other. By this step the adjacent edges of said second and third panel stand face to face to each other. None of the edges juts out.

IN THE DESCRIPTION OF DRAWINGS FIGURES

FIGS. 1–5 schematically show the stages for joining floor panels together according to the invention.

FIG. 1 shows the first step or stage. In said first step a first panel 1 is already located in a first row. A second panel 2 is positioned in a second row in said first mutual position shown generally at 20 in relation to the first panel. In said first mutual position the panels are held in an angled position to each other, as illustrated by angle 4. Adjacent longitudinal edges of the panels shown at 21 and 22 are in mutual contact. A third panel 3 is now brought into the second row and into said first mutual position also shown at 20 in relation to said first panel. In the said position, there is a mutual distance 5 between the adjacent lateral edges 23 and 24 of said second panel 2 and third panel 3.

FIG. 2 shows the intermediate step. In this intermediate step said second panel 2 and third panel 3 are angled down into said second mutual position shown generally at 25 in relation to panel 1. The panels 1, 2 and 3 are in a common plane shown at 26, but there is still a mutual distance 5 between the adjacent lateral edges 23 and 24 of panels 2 and 3.

FIG. 3 shows the second step. In said second step said second panel 2 and third panel 3 are angled into said third mutual position shown generally at 27 in relation to the first panel. In said third mutual position 27 the panels 2 and 3 are held in a second angled position, as illustrated by angle 6. But there is still a mutual distance 5 between the adjacent lateral edges of panel 2 and 3.

FIG. 4 shows the third step. In said third step panel 2 or panel 3 or both are moved in relation to the panel 1, while panel 2 and 3 are in said third mutual position in relation to panel 1, as illustrated by angle 6.

FIG. 5 shows the fourth step. In said fourth step panel 2 an 3 are angled down to said second mutual position in relation to said first panel. Thereby, all panels 1,2,3 are in the same common plane 26.

DESCRIPTION OF PREFERRED EMBODIMENTS

Figure 1:
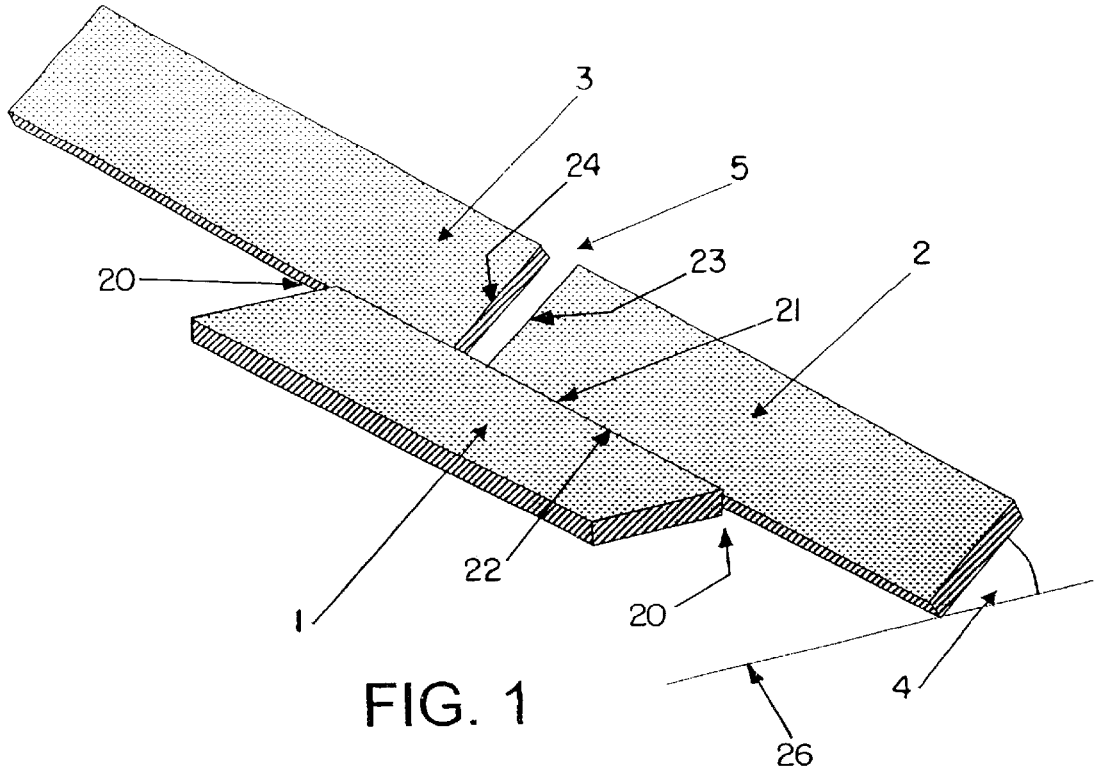
Figure 2:
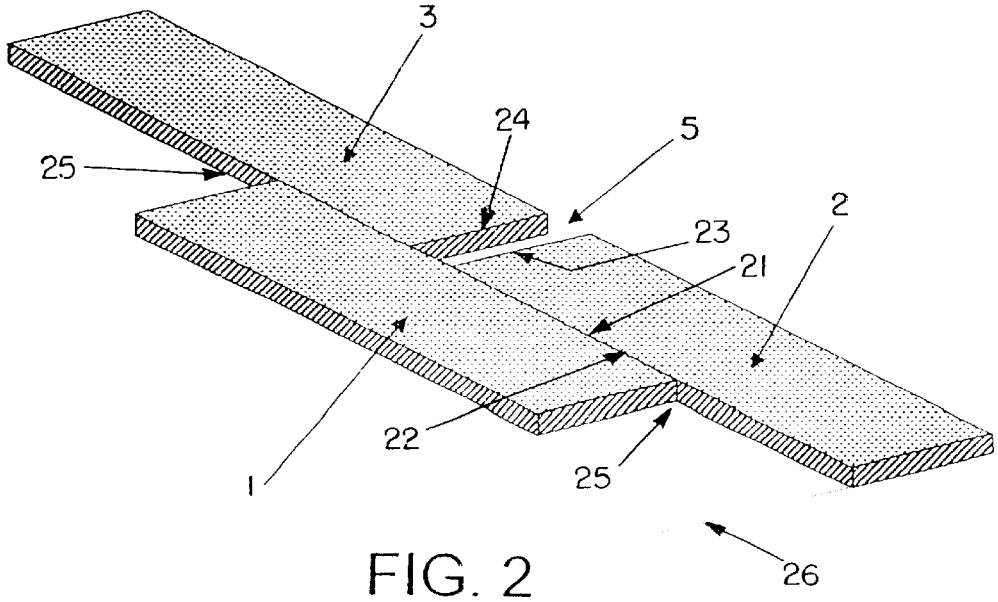
Figure 3:
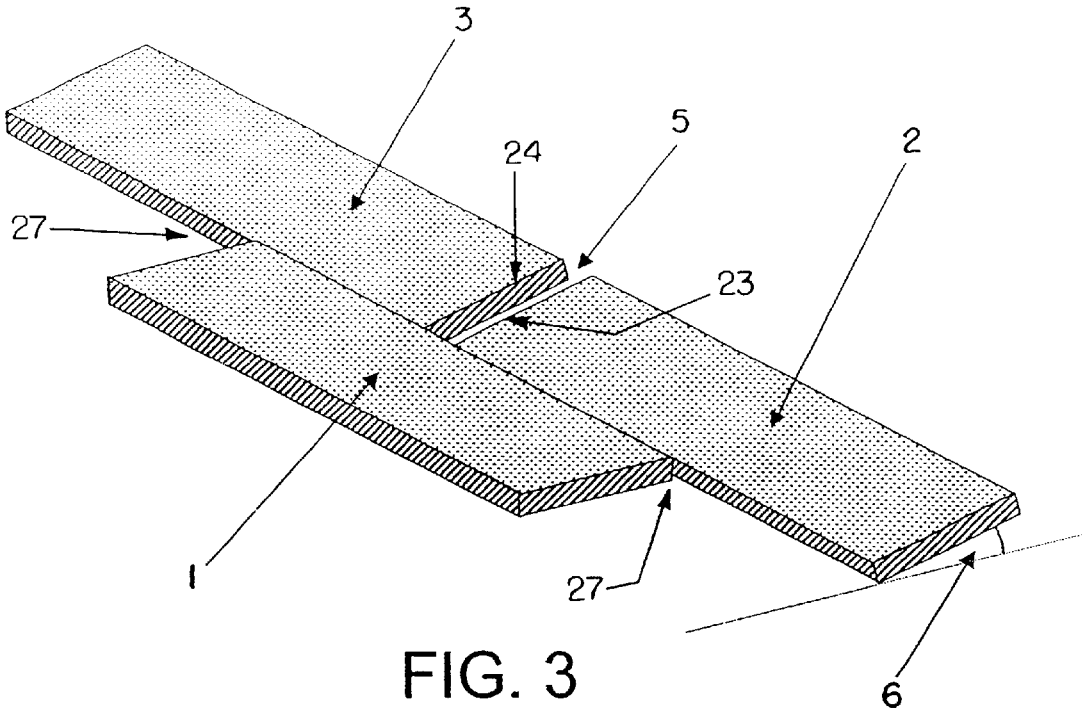
Figure 4:
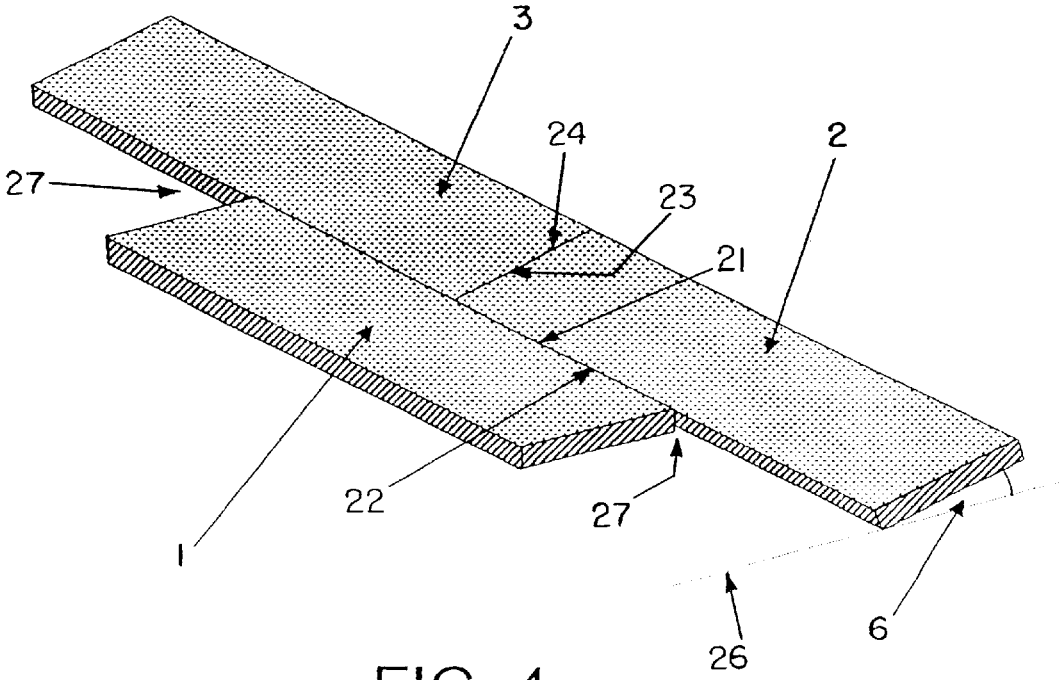
Figure 5:
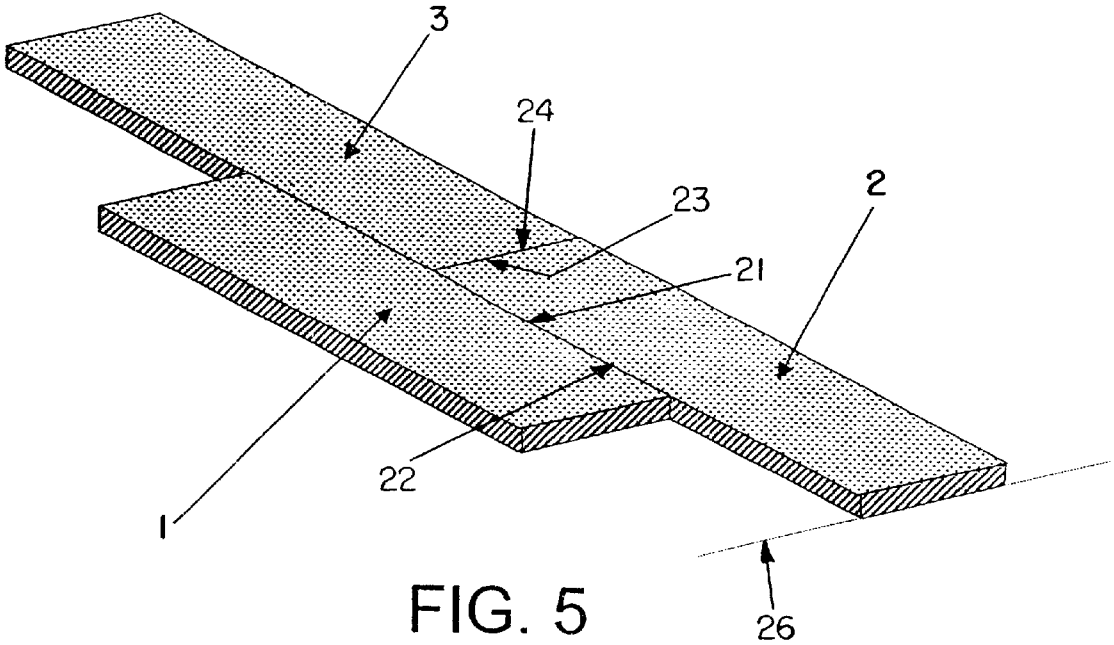
Figure 6:
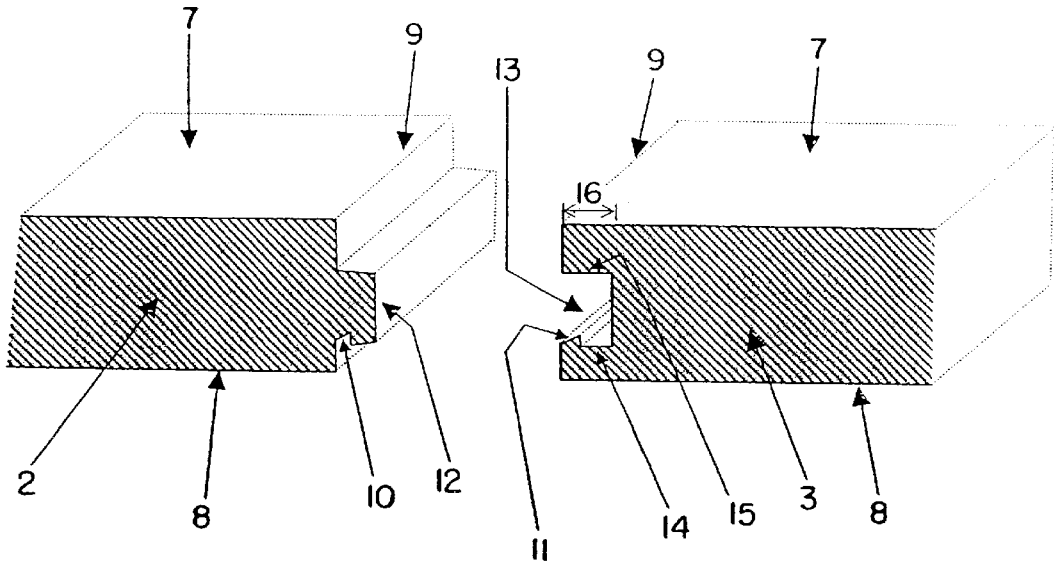
FIG. 6 illustrates in perspective a preferred embodiment of the invention concerning the locking elements disposed at adjacent lateral edges of two panels, in general at the narrow sides of those panels.

FIG. 6, to which reference is now made, illustrates a part of a cross-section of a panel 2. At its edge 9 a tongue 12 projects parallel to that edge 9. With its bottom side 8 the panel 2 and all further illustrated panels are later in contact with the floor, the opposite side is its or their top surface 7 respectively. A locking groove 10 is a first locking member and is part of the tongue 12 and is open at the rear or bottom side of the panel 8. As this panel's counterpart a further part of a cross-section of a panel 3 is shown. At this edge 9 it is provided with a second groove 13 with the flanks 14 and 15. Both flanks are of the same length 16. A projection 11 which is the second locking member is part of said second groove 13 and projects toward said top or surface 7. In a preferred embodiment of the invention the flank 14, on which said projection 11 is disposed, is flexible.

Figure 7:
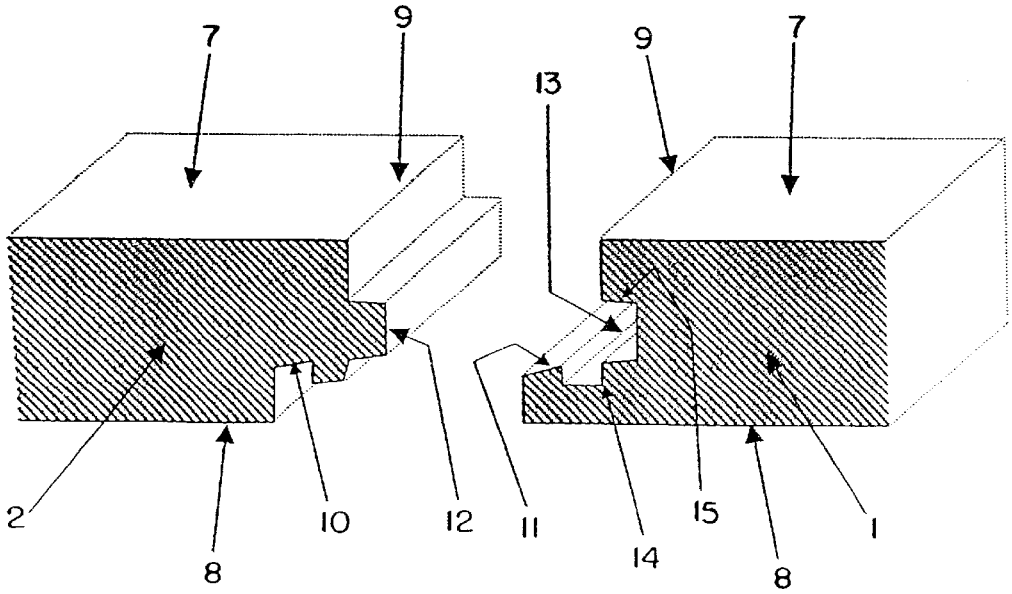
FIG. 7 illustrates in perspective a preferred embodiment of the invention concerning the locking elements disposed at adjacent edges of two panels, in general at the long sides or longitudinal edges of those panels.

FIG. 7, to which reference is now made, illustrates a part of a cross-section of a panel 2. At its edge 9 a tongue 12 projects parallel to that edge 9. A locking groove 10 is part of the tongue 12 and is open at the rear or bottom side 8 of the panel 2. As this panel's counterpart a further part of a cross-section of a panel 1 is shown. At its edge 9 it is provided with a second groove 13 with the flanks 14 and 15. A projection 11 is part of said second groove 13 and projects toward said surface 7. The flank 14, on which said projection 11 is disposed, juts out in relation to the other flank 15.

What is claimed is:

1. A method of laying and mechanically joining floor panels in parallel rows, wherein relative positions of the panels during the method can be defined as including first, second and third mutual positions, a first mutual position in which the two panels are held in a angled position relative to each other and each has adjacent joint edges in mutual contact, a second mutual position in which the two panels are located in common plane, mechanically locked to each other in a first direction that is right-angled to the common plane, mechanically locked to each other in a second direction, that is right-angled to said first direction and to said adjacent joint edges, a third mutual position in which the two panels are held in an intermediate angled position between the first and second position, wherein said method comprises the steps of:

(A) a previously laid first one of the panels is located in a first row, a second one is located in a second row and is in said first mutual position in relation to the first panel, a third panel is brought into the second row and into said first mutual position in relation to the first panel and into a position relative to the second panel such that a mutual distance is present between the second and third panel;

(B) angling the second and third panel into said third mutual position in relation to the first panel;

(C) bringing the second and third panel into the second position in relation to each other by moving one or both of the second and third panel in relation to the first panel (D) while maintaining said second position between the third and second panel, angling the second and third panel together into said second position in relation to the first panel.

2. The method according to claim 1, with a first locking member disposed at one of said adjacent joint edges, which is a locking groove, which extends parallel to and spaced from that edge, which is open at the bottom side of the panel, with a second locking member disposed at the other one of the adjacent edges, which is a projection, which extends parallel to and spaced from that edge, which projects toward the top surface of the panel.

3. The method according to claim 2, in which said locking groove is part of a tongue, which projects at one of the adjacent edges of a panel and extends parallel to that edge, and said projection is part of a second groove, which is disposed at one of said adjacent joint edges and extends parallel to that edge.

4. The method according to claim 3, in which the flanks of said second groove are of the same length.

5. The method according to claim 4, in which the flank of said second groove, on which said projection is disposed, is flexible.

6. The method of claim 3, in which said second groove has two flanks, on one of which said projection is disposed, and which one flank juts out in relation to the other flank of said groove.

7. A method of laying and mechanically joining floor panels in parallel rows, wherein relative positions of the panels during the method can be defined as including first, second and third mutual positions, a first mutual position in which the two panels are held in an angled position relative to each other and each have adjacent joint edges in mutual contact, a second mutual position in which the two panels are located in common plane, mechanically locked to each other in a first direction that is right-angled to the common plane, mechanically locked to each other in a second direction, that is right-angled to said first direction and to said adjacent joint edges, a third mutual position in which the two panels are held in an intermediate angled position between the first and second position, wherein said method comprises the steps of:

(A) a previously laid first one of the panels is located in a first row, a second one is located in a second row and is in said first mutual position in relation to the first panel, a third panel is brought into the second row and into said first mutual position in relation to the first panel and into a position relative to the second panel such that a mutual distance is present between the second and third panel;

(B) angling the second and the third panel into said second mutual position in relation to the first panel;

(C) angling the second and the third panel into said third mutual position in relation to the first panel;

(D) bringing the second and third panel into the second position in relation to each other by moving one or both of the second and third panel in relation to the first panel (E) while maintaining said second position between the third and second panel, angling the second and third panel together into said second position in relation to the first panel.

8. The method according to claim 7, with a first locking member disposed at one of said adjacent joint edges, which is a locking groove, which extends parallel to and spaced from that edge, which is open at the bottom side of the panel, with a second locking member disposed at the other one of the adjacent edges, which is a projection, which extends parallel to and spaced from that edge, which projects toward the top surface of the panel.

9. The method according to claim 8, in which said locking groove is part of a tongue, which projects at one of the adjacent edges of the panel and extends parallel to that edge, and said projection is part of a second groove which has two flanks, and which is disposed at one of said adjacent joint edges and extends parallel to that edge.

10. The method according to claim 9, in which the flanks of said second groove are of the same length.

11. The method according to claim 10, in which the flank of said second groove, on which said projection is disposed, is flexible.

12. The method according to claim 9, in which the flank of said second groove, on which said projection is disposed, juts out in relation to the other flank of said groove.

* * * * *